US009933212B2

(12) United States Patent
Phan et al.

(10) Patent No.: US 9,933,212 B2
(45) Date of Patent: Apr. 3, 2018

(54) HEAT PIPE

(71) Applicant: FUJIKURA LTD., Tokyo (JP)

(72) Inventors: Thanhlong Phan, Tokyo (JP); Yuji Saito, Tokyo (JP); Masataka Mochizuki, Tokyo (JP)

(73) Assignee: FUJIKURA LTD., Tokyo (JP)

( * ) Notice: Subject to any disclaimer, the term of this patent is extended or adjusted under 35 U.S.C. 154(b) by 468 days.

(21) Appl. No.: 14/596,287

(22) Filed: Jan. 14, 2015

(65) Prior Publication Data

US 2015/0204617 A1 Jul. 23, 2015

(30) Foreign Application Priority Data

Jan. 17, 2014 (JP) ..... 2014-007012

(51) Int. Cl.
*F28D 15/00* (2006.01)
*F28D 15/04* (2006.01)
*F28D 15/02* (2006.01)

(52) U.S. Cl.
CPC ..... *F28D 15/046* (2013.01); *F28D 15/0233* (2013.01)

(58) Field of Classification Search
CPC ..... F28D 15/04; F28D 15/046; F28D 15/02; F28D 15/0233
USPC ..... 165/104.26
See application file for complete search history.

(56) References Cited

U.S. PATENT DOCUMENTS

2005/0269065 A1* 12/2005 Chen ..... B82Y 10/00 165/104.26
2011/0303392 A1 12/2011 Horiuchi et al.
2012/0118537 A1 5/2012 Kameoka et al.

FOREIGN PATENT DOCUMENTS

JP 11-294980 A 10/1999
JP 2006275424 A * 10/2006
JP 2011-43320 A 3/2011
JP 2012009879 A * 1/2012
JP 2013-2640 A 1/2013
WO 2010/098303 A1 9/2010

* cited by examiner

*Primary Examiner* — Justin Jonaitis
(74) *Attorney, Agent, or Firm* — Sughrue Mion, PLLC

(57) ABSTRACT

A heat pipe having a wick structure for efficiently returning working fluid to an evaporating portion is provided. The heat pipe comprises a container 2 sealed at its both ends, a working fluid encapsulated in the container, and a wick structure 10 covering an inner face of the container. The wick structure 10 includes a porous wick 11 of a sintered metal powder, and a fiber wick 12 buried in the porous wick. A capillary pressure of the fiber wick 12 is weaker than that of the porous wick 11, and a pressure loss of the fiber wick 12 is smaller than that of the porous wick 11.

5 Claims, 4 Drawing Sheets

HEAT PIPE

The present invention claims the benefit of Japanese Patent Applications No. 2014-007012 filed on Jan. 17, 2014 with the Japanese Patent Office, the disclosures of which are incorporated herein by reference in its entirety.

BACKGROUND

Field of the Invention

The present invention relates to the art of a heat pipe having a wick structure constructed of sintered metal powder arranged in a sealed container.

Discussion of the Related Art

Conventional heat pipes are adapted to absorb heat from a heat generating object such as an electronic device in the form of latent heat of working fluid. In the heat pipe, the working fluid is evaporated by an external heat and condensed while radiating heat. Cooling performance of the heat pipe of this kind may be enhanced by increasing mass flow of the working fluid.

In recent years, electronic devices has been downsized and highly improved hence generate higher heat. Therefore, the heat pipes are required to be downsized while enhancing heat transport capacity. For example, given that a flat heat pipe and a cylindrical heat pipe have same widths, the flat heat pipe is thinner than the cylindrical heat pipe. However, an inner space of the flat heat pipe serving as a flow path is smaller than that of the cylindrical heat pipe.

For instance, US2012/0118537 A describes a flattened heat pipe comprising a wick structure attached to an inner flat wall of a container, and vapor flowing passages formed in curves areas of both sides of the container. Working fluid is encapsulated and circulates in the container.

US2011/0303392 A also describes a flat heat pipe comprising a wick formed by bundling a plurality of thin metal wires extending in a longitudinal direction of a container while being contacted to a predetermined portion of an inner face of the container.

In turn, JP-A-2013-2640 describes a wick structure comprising a fiber wick layer formed of a plurality of metal wires laid on an inner surface of a sealed container, and a powder wick layer laid on the fiber wick layer.

Further, JP-A-11-294980 describes a cylindrical heat pipe having a wick structure for increasing a mass flow of the working fluid flowing through a flow path from a condensing portion toward an evaporating portion.

Specifically, according to the teachings of JP-A-11-294980, the wick structure is comprised of a metal net and a sintered metal powder. An inner wall of a container is entirely covered with the metal powder, and the metal net is situated on the metal net or interposed between the container and the metal powder.

However, according to the heat pipe taught by US2012/0118537 A, a pressure loss of the wick structure may be high, and hence it may be difficult to transport the working fluid over a long distance. Although a traveling distance of the working fluid can be extended by the wick taught by US2011/0303392 A, a flow rate of the working fluid per unit of area has to be increased. According to the wick structure taught by JP-A-2013-2640, thermal resistance between the container and the wick may be too large and hence the metal powder may fall from the wick into grooves. According to the wick structure taught by JP-A-11-294980, the sintered metal powder may not be fixed to the metal net firmly thereby increasing thermal resistance.

The present invention has been conceived noting the foregoing technical problems, and it is therefore an object of the present invention is to enhance the heat transfer performance of a heat pipe by efficiently returning working fluid flowing through a wick structure arranged in a sealed container.

SUMMARY OF THE INVENTION

The present invention is applied to a heat pipe comprising a container sealed at its both ends, a working fluid encapsulated in the container, and a wick structure covering an inner face of the container. In order to achieve the above-mentioned objectives, according to the present invention, the wick structure is comprised of a porous wick constructed of a sintered metal powder, and a fiber wick extending in a length direction of the container. An outer face of the porous wick exposed to an air passage serves as an evaporating face. Specifically, the fiber wick is formed by bundling a plurality of metal fibers in a manner such that a capillary pressure is reduced to be weaker than that of the porous wick, and that a pressure loss is reduced to be smaller than that of the porous wick. the fiber wick thus structured is entirely buried in the porous wick while being contacted to the inner face of the container.

In addition, the inner surface of the container is entirely covered with the porous wick holding the fiber wick therein.

According to another aspect of the present invention, a flat container having flat portions is used as the container. In this case, an inner flat face of the flat portion contacted to a heat-generating object is covered with the porous wick holding the fiber wick.

Specifically, the flat container is flattened to have a pair of flat portions opposed to each other. According to still another aspect of the present invention, the inner flat face of one of the flat portions is covered with a first porous wick, and the inner flat face of the other flat portion is covered with a second porous wick. In this case, a first fiber wick is buried in the first porous wick while being contacted to the inner flat face of said one of the flat portion, and a second fiber wick is buried in the second porous wick while being contacted to the inner flat face of the other flat portion.

For example, not only a round column-shaped fiber wick but also a rectangular-column shaped fiber wick may be arranged in the porous wick.

Thus, in the heat pipe according to the present invention, the fiber wick is buried in the porous wick. A pressure drop of the working fluid flowing through the fiber wick is smaller than that of the working fluid flowing through the porous wick. Therefore, the working fluid in the liquid phase is allowed to return to the evaporating portion over the long distance so that the heat transfer capacity of the heat pipe can be enhanced. In addition, the working fluid can be pumped efficiently into the fiber wick by the capillary action of the porous wick so that dry-out of the fiber wick can be prevented.

As described, the fiber wick is entirely buried in the porous wick while being contacted to the inner face of the container. That is, the fiber wick is enclosed by the porous wick exerting strong capillary pressure. Therefore, the working fluid can be spread homogeneously all over the wick structure.

According the present invention, the inner surface of the container may be covered entirely with the porous wick holding the fiber wick. In this case, the working fluid can be spread homogeneously all over the wick structure. In addition, a thermal resistance between the inner face of the container and an outer face of the porous wick can be reduced.

In case of using the flat container, only the inner flat face of the flat portion contacted to the heat-generating object is covered with the porous wick holding the fiber wick. In this case, an air passage can be ensured sufficiently in the container so that the working fluid is allowed to be returned efficiently to the evaporating portion. Consequently, the heat transfer capacity of the heat pipe can be enhanced.

In case of using the flat container, alternatively, the inner flat face of one of the flat portions may be covered with the first porous wick holding the first fiber wick, and the inner flat face of the other flat portion may be covered with the second porous wick holding the second fiber wick. In this case, the working fluid can be returned more efficiently to the evaporating portion, and the heat transfer capacity of the heat pipe can be further enhanced.

In case of using the rectangular-column shaped fiber wick, a cross-sectional area of the fiber wick can be ensured sufficiently in the flat container to allow the working fluid to flow smoothly therethrough.

BRIEF DESCRIPTION OF THE DRAWINGS

Features, aspects, and advantages of exemplary embodiments of the present invention will become better understood with reference to the following description and accompanying drawings, which should not limit the invention in any way.

DETAILED DESCRIPTION OF THE PREFERRED EMBODIMENTS

Preferred examples of the present invention will now be explained in more detail with reference to the accompanying drawings. The heat pipe of the present invention is comprised of working fluid encapsulated in a sealed container, a porous wick structure constructed of a sintered metal powder, and a water channel arranged in the porous wick. The water channel is constructed of bundled metal fibers so that fluid flow resistance of the water channel is smaller than that of the porous wick. The working fluid is evaporated when it is heated, and condensed when heat is removed therefrom.

Figure 1:
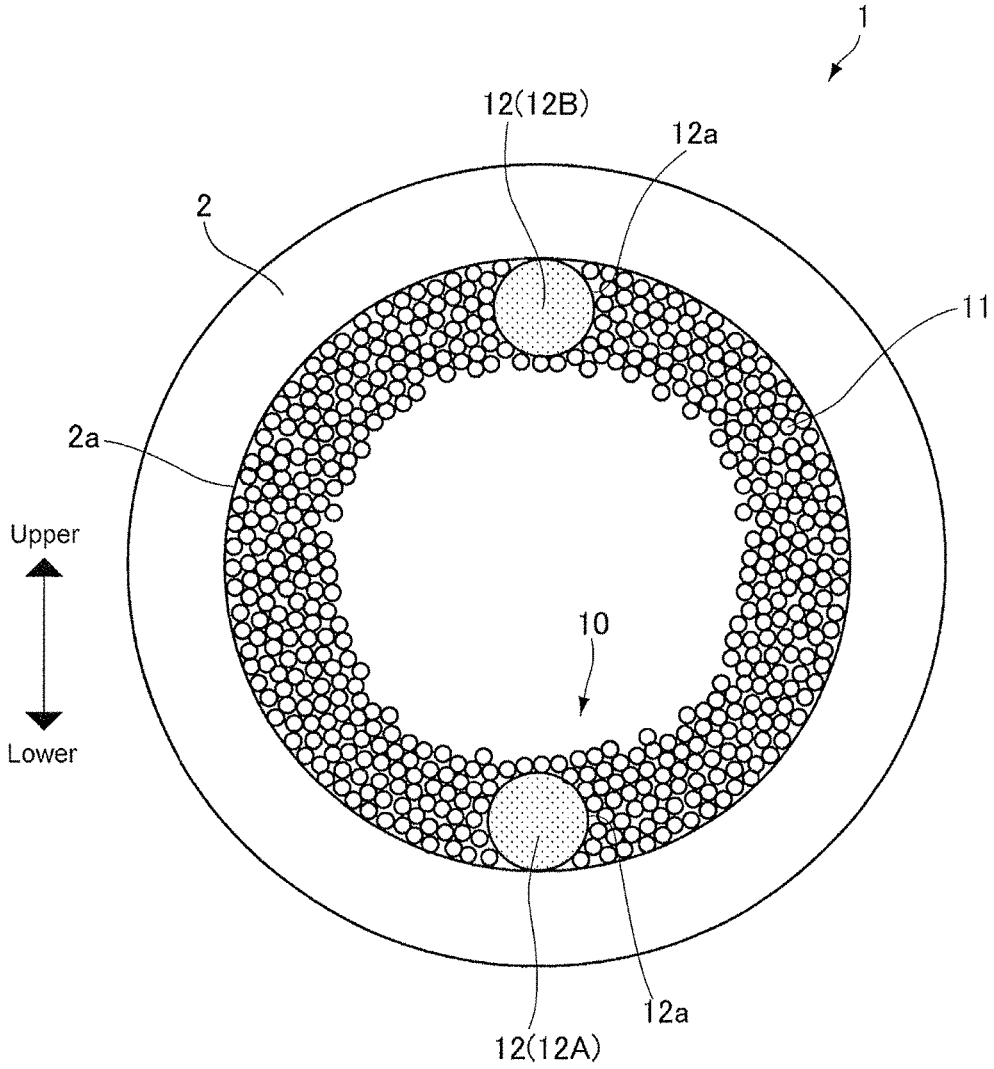
FIG. 1 a cross-sectional view schematically showing a heat pipe according to the first example of the present invention.

Referring now to FIG. 1, there is shown cross-section of the heat pipe according to the first example of the present invention. In FIG. 1, the arrow situated beside the heat pipe 1 indicates the vertical direction of the heat pipe 1.

The first example relates to a cylindrical heat pipe having a container 2 whose cross-sectional shape is round. The container 2 is a cylindrical member made of metal such as copper, and although not especially illustrated in FIG. 1, both longitudinal ends thereof are closed. The phase-changeable working fluid is held in the container 2, and for example, water, alcohol, ammonia water etc. may be used as the working fluid.

A curvature of an inner face 2*a* of the container 2 in a circumferential direction is entirely constant, and a thickness of the inner face 2*a* is also constant. In addition, a surface of the inner face 2*a* is entirely smooth. Thus, a smooth pipe is employed as the container 2.

The inner face 2*a* of the container 2 is covered entirely with a wick structure 10 so that the working fluid condensed at a condensing portion is pumped by an capillary action of the wick structure 10 to an evaporating portion. In the heat pipe 1, specifically, the working fluid is evaporated at the evaporating portion by an external heat, and the vaporized working fluid migrates though an internal space serving as an air passage to the condensing portion. The heat of the vaporized working fluid is radiated at the condensing portion so that the working fluid is condensed again and penetrates into the wick structure 10. Then, the working fluid thus condensed at the condensing portion is returned to the evaporating portion by the capillary pumping of the wick structure 10.

As illustrated in FIG. 1, the wick structure 10 is comprised of a porous wick 11 constructed of a sintered copper powder, and a fiber wick 12 constructed of bundled copper fibers. Those porous wick 11 and fiber wick 12 are sintered together at a predetermined temperature.

The wick structure 10 may also be constructed of other known material. For example, the fiber wick 12 may also be constructed of other metal fibers or carbon fibers. In the description, reference numeral 12*a* represents an outer circumference of the bundled fibers forming the fiber wick 12.

The fiber wick 12 is buried in the porous wick 11 while extending in a length direction of the container 2, and both porous wick 11 and fiber wick 12 are adapted to perform capillary pumping. That is, the fiber wick 12 serves as a water channel in the porous wick 11, and the fluid flow resistance of the fiber wick 12 is smaller than that of the porous wick 12.

As depicted in FIG. 1, the fiber wick 11 is bundled into a round column-shape whose cross-section is substantially circular, and the outer circumference 12*a* of the fiber wick 11 is contacted to both inner face 2*a* of the container 2 and porous wick 11. That is, a thickness of the porous wick 11 formed into a cylindrical shape is thicker than a diameter of the fiber wick 12.

According to the first example of the heat pipe 1, there are two fiber wicks 12 are arranged parallel to each other in the porous wick 11. Specifically, a first fiber wick 12A penetrates through the lowest portion of the porous wick 11 in FIG. 1 while being contacted with the inner face 2*a* of the container 2, and a second fiber wick 12B penetrates through the upper portion of the porous wick 11 in FIG. 1 while being contacted with the inner face 2*a*. That is, the first fiber wick 12A and the second fiber wick 12B are arranged symmetrically across a center axis of the heat pipe 1, and diameters of the first and the second fiber wicks 12A and 12B are substantially identical to each other. In addition, the first and the second fiber wicks 12A and 12B are completely buried in the porous wick 11 without being exposed to the air passage.

Specifically, the porous wick 11 is formed by sintering copper powder, and according the examples, average diameter of the copper powder is approximately 125 μm. In the porous wick 11, clearances among the copper powders serve as flow passages, however, structures of the flow passages are rather complicated. As described, the inner face 2*a* of the container 2 is entirely covered with the porous wick 11. Therefore, the flow passages are created not only among the copper powders forming the porous wick 11 but also between an outer circumference of the porous wick 11 and the inner face 2*a* of the container 2. The working fluid condensed at the condensing portion is returned to the evaporating portion by the capillary pumping of the porous wick 11 through the flow passages thus formed.

As also described, each fiber wick 12A and 12B is individually buried in the porous wick 11 while being contacted to the inner face 2*a* of the container 2. That is, the fiber wick can be kept to be bundled by the porous wick 11 and fixed to the inner face 2*a* without using a bundling wire or the like. In addition, the flow passages are also created between the copper fibers of the fiber wick 12 and the copper powders of the porous wick 11.

According to the examples, specifically, the fiber wick 12 is formed by bundling the copper fibers whose diameters are within the range including 50 to 100 μm, and each clearance among the bundled fibers serves as linear flow passages extending in the length direction of the heat pipe 1. Such linear flow passages are also formed on both sides of a contact portion between the fiber wick 12 and the inner face 2*a* of the container 2. The working fluid condensed at the condensing portion is returned to the evaporating portion by the capillary pumping of those linear flow passages.

The capillary pumping of the flow passage is enhanced by reducing radius of capillary. According to the preferred examples, the clearance among the copper powders, that is, the radius of capillary of the porous wick 11 is smaller than the clearance among the copper fibers of the fiber wick 12. Namely, the capillary pumping of the porous wick 11 is stronger than that of the fiber wick 12.

However, in the wick structure 10 thus structured, a pressure loss is caused depending on configurations of the flow passages. According to the preferred example, specifically, the flow passages in the porous wick 11 are complicated as a maze but the flow passages in the fiber wick 12 extend straight. That is, the pressure loss of the fiber wick 12 is smaller than that of the porous wick 11.

Thus, in the wick structure 10, the fiber wick 12 in which the pressure loss is smaller is buried in the porous wick 11 whose capillary pumping is stronger. This means that the porous wick 11 has the fiber wicks 12 functioning as the water channels where the working fluid is allowed to flow smoothly therethrough.

In the wick structure 10, therefore, the porous wick 11 mainly exerts capillary pumping and the fiber wick 12 mainly serves as the water channel so that the working fluid can be returned to the evaporating portion over the long distance.

Thus, according to the first example of the present invention, the wick structure 10 has independent sections such as the porous wick 11 to exert strong capillary pumping and the fiber wick 12 to allow the working fluid to flow smoothly therethrough. Therefore, a distance between the condensing portion and the evaporating portion can be extended so that the heat transfer capacity of the heat pipe 1 can be enhanced.

As described, since the inner face 2*a* of the container 2 is covered substantially entirely with the wick structure 10, the working fluid is allowed to penetrate into the wick structure 10 entirely and homogeneously. In addition, thermal resistance between the inner face 2*a* of the container 2 and the wick structure 10 can be reduced.

As also described, the fiber wick 12 is entirely buried in the porous wick 11. That is, an evaporating face of the wick structure 10 facing to the air passage is formed only by the copper powders of the porous wick 11 so that the capillary pressure is also exerted by the evaporating face. Therefore, the working fluid will not be dried out at the evaporating portion by also pumping the working fluid by the capillary action of the evaporating face to the evaporating portion. That is, the pressure loss of the porous wick 11 can be covered by the capillary pumping of the evaporating face thereof. In addition, since only the porous wick 11 is exposed to the air passage, scattering of the condensed working fluid caused by the countercurrent of the vaporized working fluid can be reduced. Therefore, heart transfer capacity of the heat pipe can be enhanced in comparison with that of the case in which the fiber wick is exposed to the air passage. Besides, given that the fiber wick is exposed to the air passage, the pressure loss of the porous wick 11 cannot be covered by the capillary pumping of the evaporating face and the working fluid in the evaporating portion would be dried out. In addition, the working fluid flowing through the fiber wick may be scattered by the countercurrent of the vapor.

Further, heat transfer efficiency of the wick structure 10 can be enhanced under the top heat mode where the evaporating portion is situated above the condensing portion. In addition, the heat transfer capacity of the wick structure 10 will not be impaired even if the posture of the heat pipe 1 is changed. According to the first example of the present invention, the heat transfer capacity of the heat pipe 1 can be enhanced approximately 150 to 200 percent in comparison with those of the conventional heat pipes.

The structure of the heat pipe 1 according to the first example may be modified according to need within the spirit of the present invention. For example, a thickness of the porous wick may be altered arbitrarily unless the fiber wicks are not exposed to the air passage formed in an inner circumferential side of the porous wick. In other words, the thickness of the porous wick may be altered arbitrarily within the range thicker than the diameter of the fiber wick but possible to maintain the air passage.

Likewise, particle diameter of the copper powder forming the porous wick may also be altered to change a size of the clearances created among the particles. In addition, the diameters of the first fiber wick and the second fiber wick are not necessarily to be identical to each other but may be differentiated arbitrarily, and diameters of the fibers forming the fiber wick may also be altered to change a size of the clearance created among the fibers.

Figure 2:
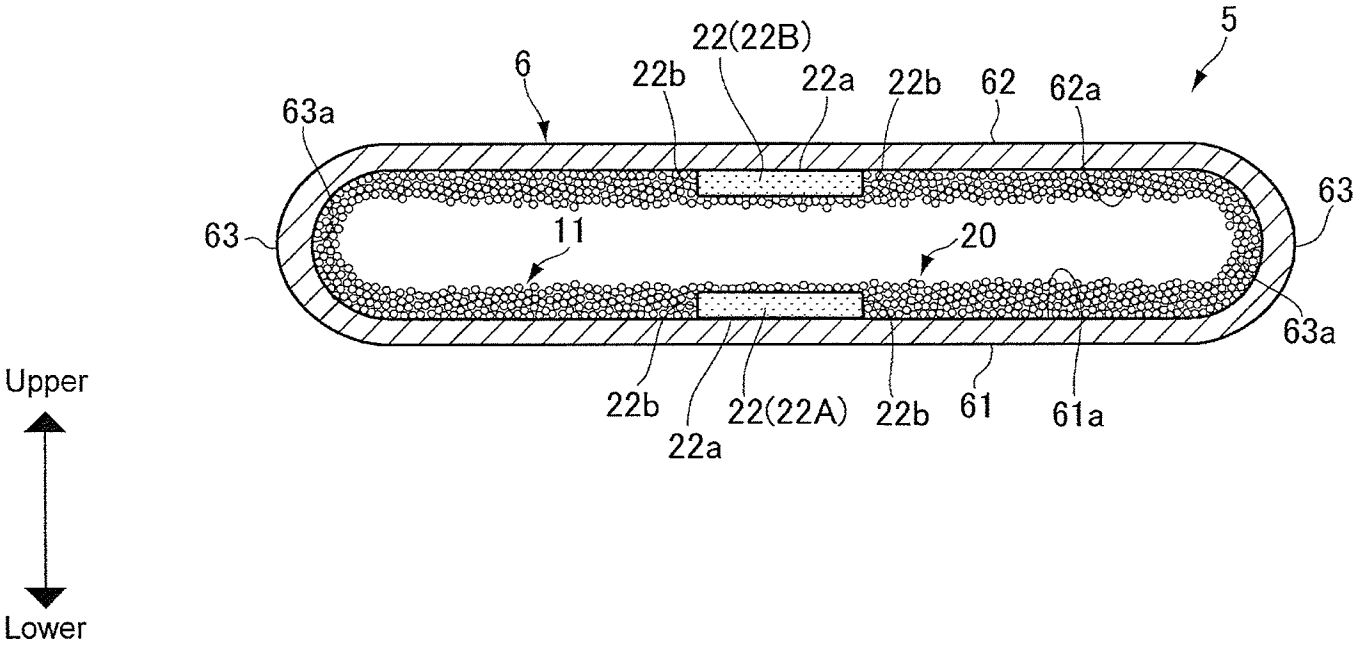
FIG. 2 a cross-sectional view schematically showing a heat pipe according to the second example of the present invention.

Next, the second example of the present invention will be explained with reference to FIG. 2. As illustrated in FIG. 2, the second example relates to a flat heat pipe in which a container is flattened. As the first example, an inner face of the container is covered entirely with the porous wick and a pair of fiber wicks is buried in the porous wick. Although the fiber wick shown in FIG. 2 is formed into a rectangular-column shape, each fiber wick may also be formed into a round-column shape. In the following explanation, explanations for the elements identical to those of the first example will be omitted by allotting common reference numerals.

As shown in FIG. 2, the heat pipe 5 according to the second example is provided with a flattened container 6. Specifically, the flat container 6 comprises a lower flat portion 61, an upper flat portion 62, and curved portions 63 connecting the flat portions 61 and 62. Accordingly, an inner face of the flat container 6 includes a lower flat face 61*a*, an upper flat face 62*a*, and curved faces 63*a* individually formed between the flat faces 61*a* and 62*a*.

The inner face 6*a* of the flat container 6 is entirely covered with a wick structure 20 comprised of the porous wick 11 and fiber wicks 22 constructed of the copper fibers. According to the second example, each fiber wick 22 is formed into a rectangular-column shape and also buried entirely in the porous wick 11. Specifically, each fiber wick 22 is individually formed into a rectangular-column shape whose width is longer than a thickness while extending in the length direction of the heat pipe 5. The fiber wick 22 also functions as the water channel where the fluid flow resistance is smaller than that of the porous wick 11.

As described, the inner face of the flat container 6, specifically, the lower flat face 61*a*, the upper flat face 62*a*, and the curved faces 63*a* are entirely covered with the porous wick 11.

The fiber wick 22 includes a first fiber wick 22A attached to a width center of the lower flat face 61*a* of the flat container 6, and a second fiber wick 22B attached to a width center of the upper flat face 62*a* of the flat container 6. Specifically, a long face 22*a* of the first fiber wick 22A is contacted to the lower flat face 61*a*, and a long face 22*a* of the second fiber wick 22B is contacted to the upper flat face 62*a*. A thickness of each fiber wick 22A and 22B falls within a thickness of the porous wick 11 to be buried entirely therein.

A width of each fiber wick 22A and 22B individually falls within a predetermined range on both sides of the width center of the flat container 6, and sintered at a predetermined temperature to be fixed to the lower flat face 61*a* and to the upper flat face 62*a*.

Thus, the thickness of the porous wick 11 is thicker than thicknesses of the fiber wicks 22A and 22B to enclose those fiber wicks entirely. Therefore, side faces 22*b* of the fiber wicks 22A and 22B are also contacted to the porous wick 11.

Here, it is to be noted that the diameter of the fibers used to form the fiber wick 22 may also be altered arbitrarily to change the clearances among the fibers. In addition, the thicknesses and widths of the fiber wicks 22A and 22B are also not necessarily to be identical to each other but may be differentiated arbitrarily.

Thus, according to the second example, each fiber wick 22A and 22B is individually formed into a rectangular-column shape in which the width thereof is wider than the thickness thereof. Therefore, even if the thickness of the flat container 5 is restricted, a cross-sectional area of the fiber wick 22 functioning as the water channel can be ensured sufficiently to allow the working fluid to flow smoothly therethrough. In addition, since the inner face of the heat pipe 5 is entirely covered with the porous wick holding the fiber wicks therein, the heat transfer capacity of the heat pipe 5 can be enhanced.

Figure 3:
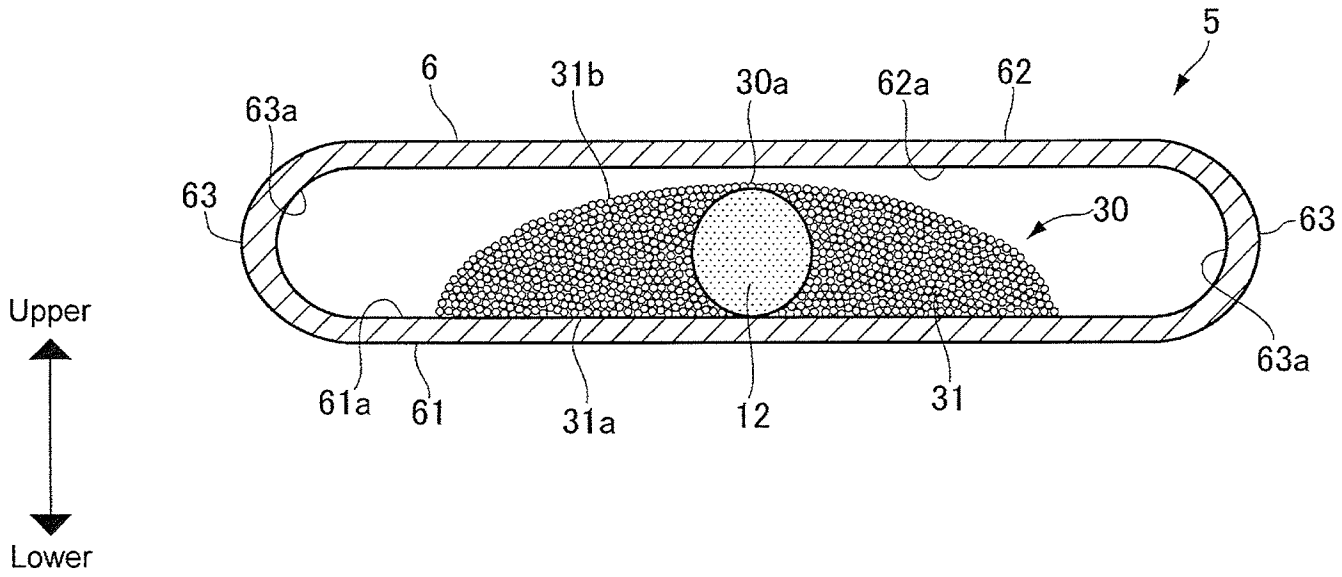
FIG. 3 a cross-sectional view schematically showing a heat pipe according to the third example of the present invention.

In turn, here will be explained the third example of the present invention with reference to FIG. 3. The third example also relates to a flat heat pipe having the flat container but configurations of the wick structure is altered as shown in FIG. 3. In the following explanation, explanations for the elements identical to those of the foregoing examples will also be omitted by allotting common reference numerals.

As shown in FIG. 3, a wick structure 30 arranged in the flat container 6 is also comprised of a porous wick 31 constructed of a sintered copper powder and the fiber wick 12 buried in the porous wick 31.

The wick structure 30 is arranged only on the lower flat portion 61 of the flat container 6 at the width center. Specifically, a width of the wick structure 30 is narrower than that of the lower flat face 61*a*, and a height of the wick structure 30 is shorter than the clearance between the upper and lower flat faces 61*a* and 62*a*. Thus, according to the third example, the upper flat face 62*a* is not covered with the wick structure. In addition, the porous wick 31 is heaped to be higher than a middle level of the clearance between the upper and lower flat faces 61*a* and 62*a*.

Specifically, the porous wick 31 is heaped on the lower flat face 61*a* in a manner to have a hemioval cross-sectional shape while extending in the length direction of the heat pipe 5. The fiber wick 12 is also buried entirely in the porous wick 31 thus structured while being contacted with the lower flat face 61*a*.

That is, the porous wick 31 is comprised of a flat face 31*a* contacted to the lower flat face 61*a* of the flat container 6, and a curved face 31*b* bulging toward the upper flat face 62*a*. The curved face 31*b* is exposed to the air passage of the flat container 6 to serve as the evaporating face. A peak 30*a* of the curved face 31*b* is situated higher than the fiber wick 12 buried in the porous wick 31 without being contacted to the upper flat face 62*a*. Thus, only the porous wick 31 is exposed to the vaporized working fluid flowing through the air passage.

The wick structure 30 thus structured is sintered in the flat container 6, and the flat face 31*a* of the porous wick 31 is fixed to the lower flat surface 61*a* of the flat container 6. Consequently, the fiber wick 12 is held and bundled in the porous wick 31 while being contacted to the lower flat surface 61*a* with or without being fixed thereto.

Alternatively, the rectangular-column shaped fiber wick 22 of the second example shown in FIG. 2 may also be applied to the heat pipe 5 according to the third example. In this case, one of the long faces 22*a* of the fiber wick 22 is contacted to the lower flat face 61*a* of the flat container 6, and the fiber wick 22 is also buried entirely in the porous wick 31.

Thus, according to the third example, the porous wick 31 is heaped to have a hemioval cross-sectional shape without being contacted to the upper flat surface 62*a* of the flat container 6 so that the inner space functioning as the air passage can be sufficiently ensured especially on both sides of the porous wick 30. Therefore, fluid puddle will not be caused even at the peak 30*a* where the clearance between the porous wick 31 and the upper flat surface 62*a* is narrowest so that the strongest capillary pumping is exerted. That is, since the clearance between the porous wick 31 and the upper flat surface 62*a* is getting wider on both sides of the porous wick 31, the capillary pressure acting therebetween is weakened on both sides of the porous wick 31 so that such fluid puddle can be prevented. Consequently, the heat transfer capacity of the heat pipe can be enhanced.

In addition, in case of using the rectangular-column shaped fiber wick 22, the cross-sectional area of the fiber wick serving as the water channel can be ensured sufficiently even if the thickness of the wick structure is thinned to be fitted into the flat container. Therefore, the working fluid is allowed to flow through the fiber wick smoothly so that the heat transfer capacity of the heat pipe can be enhanced.

Figure 4:
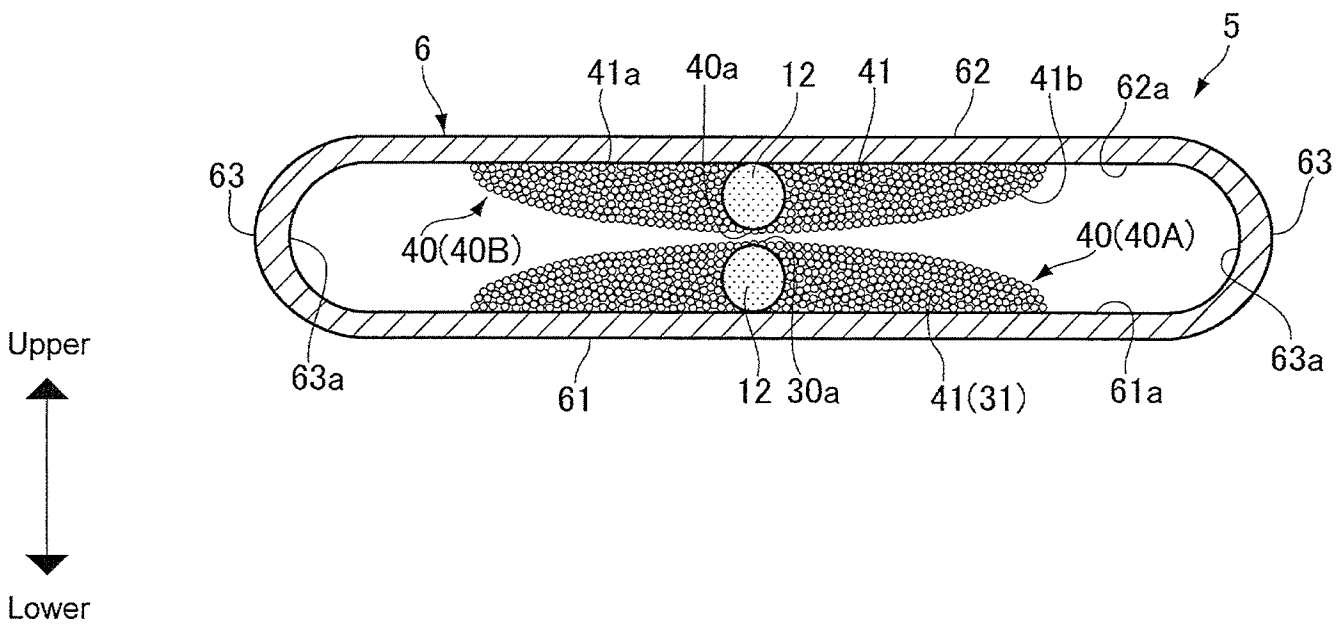
FIG. 4 a cross-sectional view schematically showing a heat pipe according to the fourth example of the present invention.

Next, the fourth example of the present invention will be explained with reference to FIG. 4. The fourth example also relates to a flat heat pipe having the flat container but configurations of the wick structure is altered as shown in FIG. 4. In the following explanation, explanations for the elements identical to those of the foregoing examples will also be omitted by allotting common reference numerals.

As illustrated in FIG. 4, according to the fourth example, a pair of wick structures 40 is arranged on both upper and lower flat surfaces of the flat container 6. Specifically, the wick structure 40 includes a first wick structure 40A arranged on the width center of the lower flat face 61*a* of the flat container 6, and a second wick structure 40B arranged on the width center of the upper flat face 62*a* of the flat container 6. That is, according to the fourth example, each porous wick 41 is heaped to be lower than a middle level of the clearance between the upper and lower flat faces 61*a* and 62*a*. Thus, the height of the wick structure 40 from the lower flat face 61*a* of the container 6 to the peak of the porous wick 41 is altered.

As described, the second wick structure 40B is formed on the width center of the upper flat face 62*a* of the flat container 6. Specifically, a width of the second wick structure 40B is narrower than that of the upper flat face 62*a*, and a height of the second wick structure 40B is also lower than a middle level of the clearance between the upper and lower flat faces 61*a* and 62*a*. Thus, according to the fourth example, the wick structure 40 is arranged on both upper and lower flat faces 61*a* and 62*a* of the flat container 6. As the third example, the fiber wick 12 is buried in each porous wick 41 constructed of the sintered copper powder.

The porous wick 41 is also heaped on each flat face 61*a* and 62*a* in a manner to have a hemioval cross-sectional shape while extending in the length direction of the heat pipe 5. The fiber wick 12 is also buried entirely in each porous wick 41 thus structured while being contacted with the flat face 61*a* or 62*a*.

The porous wick 41 is also comprised of a flat face 41*a* contacted to the flat face 61*a* or 62*a* of the flat container 6, and a curved face 41*b* bulging from the flat face. Each curved face 41*b* is also exposed to the air passage of the flat container 6 to serve as the evaporating face, and a peak 40*a* of the first wick structure 40A and a peak 40*a* of the second wick structure 40B are isolated from each other. Thus, according to the fourth example, only the porous wicks 41 are exposed to the vaporized working fluid flowing through the air passage.

Each wick structure 30 thus structured is sintered in the flat container 6, and the flat face 41*a* of the porous wick 41 is fixed to individually to the upper and lower flat surfaces 61*a* and 62*a* of the flat container 6. Consequently, the fiber wick 12 is held and bundled in the porous wick 41 while being contacted to the flat surface 61*a* or 62*a* with or without being fixed thereto. That is, the fiber wick 12 can be bundled without using a bundling wire or the like.

Alternatively, the rectangular-column shaped fiber wick 22 of the second example shown in FIG. 2 may also be applied to the heat pipe according to the fourth example. In this case, one of the long faces 22*a* of the fiber wick 22 is contacted to the flat face 61*a* or 62*a* of the flat container 6, and the fiber wick 22 is also buried entirely in each porous wick 41.

According to the heat pipe of the fourth example, therefore, the heat of the cooling object can be transported efficiently even if the cooling object is attached to the upper plate of the heat pipe. In addition, a contact area between the evaporating face contacted to the liquid flow and the air passage for the vapor flow is smaller than that of the second example shown in FIG. 2. Therefore, the flow of the working fluid in the liquid phase will not be disturbed by the counter vapor flow in the air passage. Therefore, the heat transfer efficiency can be enhanced. Further, the heat pipe according to the fourth example can efficiently transport not only the heat of the heat-generating object attached to the lower flat portion 61 but also the heat of the heat-generating object attached to the upper flat portion 62.

In addition, in case of using the rectangular-column shaped fiber wick 22, the cross-sectional area of the fiber wick serving as the water channel can be ensured sufficiently even if the thickness of the wick structure is thinned to be fitted into the flat container. Therefore, the working fluid is allowed to flow through the fiber wick smoothly so that the heat transfer capacity of the heat pipe can be enhanced.

It is understood that the invention is not limited by the exact construction of the foregoing first to fourth examples, but that various modifications may be made without departing from the scope of the inventions.

What is claimed is:

1. A heat pipe, comprising:

a container that is sealed at its both ends;

a working fluid that is encapsulated in the container; and a wick structure that covers an inner face of the container;

wherein the wick structure comprises a porous wick constructed of a sintered metal powder, and a fiber wick extending in a length direction of the container;

wherein the porous wick comprises an evaporating face on its outer face being exposed to an air passage;

wherein the fiber wick is formed by bundling a plurality of metal fibers in a manner such that a capillary pressure is reduced to be weaker than that of the porous wick, and that a pressure loss is reduced to be smaller than that of the porous wick;

wherein the fiber wick is entirely buried in the porous wick while being contacted to the inner face of the container;

wherein only the porous wick is exposed to the air passage; and wherein the porous wick is in contact with the inner face of the container.

2. The heat pipe as claimed in claim 1, wherein the inner surface of the container is entirely covered with the porous wick holding the fiber wick therein.

3. The heat pipe as claimed in claim 1, wherein the container comprises a flat container that is flattened to have flat portions;

wherein the inner face comprises an inner flat face of the flat portion; and wherein the porous wick holding the fiber wick covers only the inner flat face of the flat portion contacted to a heat-generating object.

4. A heat pipe, comprising:

a container that is sealed at its both ends;

a working fluid that is encapsulated in the container; and a wick structure that covers an inner face of the container;

wherein the wick structure comprises a porous wick constructed of a sintered metal powder, and a fiber wick extending in a length direction of the container;

wherein the fiber wick is formed by bundling a plurality of metal fibers in a manner such that a capillary pressure is reduced to be weaker than that of the porous wick, and that a pressure loss is reduced to be smaller than that of the porous wick;

wherein the container comprises a flat container that is flattened to have a pair of flat portions opposed to each other;

wherein the porous wick comprises a first porous wick covering and in contact with the inner flat face of one of the flat portions, and a second porous wick covering and in contact with the inner flat face of the other flat portion; and wherein the fiber wick comprises a first fiber wick that is buried in the first porous wick while being contacted to the inner flat face of said one of the flat portions, and a second fiber wick that is buried in the second porous wick while being contacted to the inner flat face of the other flat portion.

5. The heat pipe as claimed in claim 1, wherein the fiber wick is a rectangular-column shaped fiber wick.

* * * * *